United States Patent [19]

Hilhorst et al.

[11] 4,449,023

[45] May 15, 1984

[54] TRANSPARENT SWITCH HAVING FINE LINE CONDUCTORS

[75] Inventors: Jacques J. Hilhorst, Greensboro; Donald G. Stillie, Winston-Salem, both of N.C.

[73] Assignee: AMP Incorporated, Harrisburg, Pa.

[21] Appl. No.: 452,642

[22] Filed: Dec. 23, 1982

[51] Int. Cl.[3] ..... H01H 3/12

[52] U.S. Cl. ..... 200/159 B; 200/5 A; 200/313

[58] Field of Search ..... 200/159 B, 310, 313, 200/314, 317, 275, 5 A; 313/477 R, 479

[56] References Cited

U.S. PATENT DOCUMENTS

| | | | |
|---|---|---|---|
| 3,886,335 | 5/1975 | Hendricks | 200/159 B |
| 4,066,853 | 1/1978 | Zenk | 200/5 A |
| 4,066,855 | 1/1978 | Zenk | 200/5 A |
| 4,143,253 | 3/1979 | Wagner et al. | 200/5 A |
| 4,360,716 | 11/1982 | Fiorella | 200/5 A |

FOREIGN PATENT DOCUMENTS 2339460 2/1974 Fed. Rep. of Germany ... 200/159 B

*Primary Examiner*—John W. Shepperd
*Assistant Examiner*—Ernest G. Cusick
*Attorney, Agent, or Firm*—Katherine A. Nelson

[57] ABSTRACT

A membrane switch assembly for mounting on a cathode ray tube is disclosed. The assembly is comprised of two layers of transparent film having spaced-apart parallel double hairline conductors deposited on the internal surfaces of both layers. The internal surfaces are separated by an insulating ultraviolet curable polymer spacer applied in parallel strips over the conductors, the spacer being discontinuous at the switch sites. The conductors cross and are normally spaced from each other at the switch sites so that when the switch is closed by applying force to bring the two layers of conductors together, the electrical circuit can be completed at any one of four locations. This ensures completion of the electrical circuit even if force has been applied at the outer edge of the switch site.

8 Claims, 13 Drawing Figures

TRANSPARENT SWITCH HAVING FINE LINE CONDUCTORS

FIELD OF THE INVENTION

This invention relates to membrane switch assemblies of the type that are used on cathode ray tubes.

BACKGROUND OF THE INVENTION

In today's technological world, there is an increasing need for membrane switch assemblies that can be mounted on cathode ray tubes (CRT's). An ever increasing amount of software is becoming available that requires the user to answer questions by pressing appropriate areas of a CRT equipped with a membrane switch assembly.

These assemblies are generally made from two layers of essentially transparent film, the internal surfaces of each layer having conductors deposited thereon, separated by a third layer of film containing openings for switch sites. The conductors on the layers cross and are normally spaced from each other at the switch sites.

When such a device is operated, it is highly desirable that the assembly be essentially optically clear to the operator. For this reason, assemblies having conductive ink traces are generally unacceptable. The width of the ink trace is visible to the naked eye. Assemblies of the type having narrow hairline conductors are generally more acceptable.

Use of the hairline conductors, however, can cause other problems. An electrical circuit can be completed only when the conductors from the two layers are brought in contact with each other. The conductors, being extremely narrow, present a relatively small switch site area. Failure to press on the point at which the conductors cross usually means the circuit is not completed. Furthermore, a break in a hairline conductor also prevents the completion of the circuit.

By using essentially parallel double hairline conductors instead of single hairline conductors, the invention disclosed herein solves the above problems by providing a larger area for applying pressure to complete the circuit and also by providing for redundancy in the event a break should occur in a hairline conductor. At each switch site there are four possible points of electrical contact. In addition to the double hairline conductor, the disclosed invention uses a polymer spacer that is deposited on both layers of film over the hairline conductors themselves, except for the switch sites. The polymer therefore is a plating mask as well as a spacer.

Plating of the conductors in membrane switches of this type is often desirable. It is more economical to plate just the switch sites rather than the complete conductors. Having a spacer that also serves as a plating mask eliminates the need to apply and then remove a separate plating mask from the conductors.

PREFERRED EMBODIMENT OF THE INVENTION

Figures 1, 2:
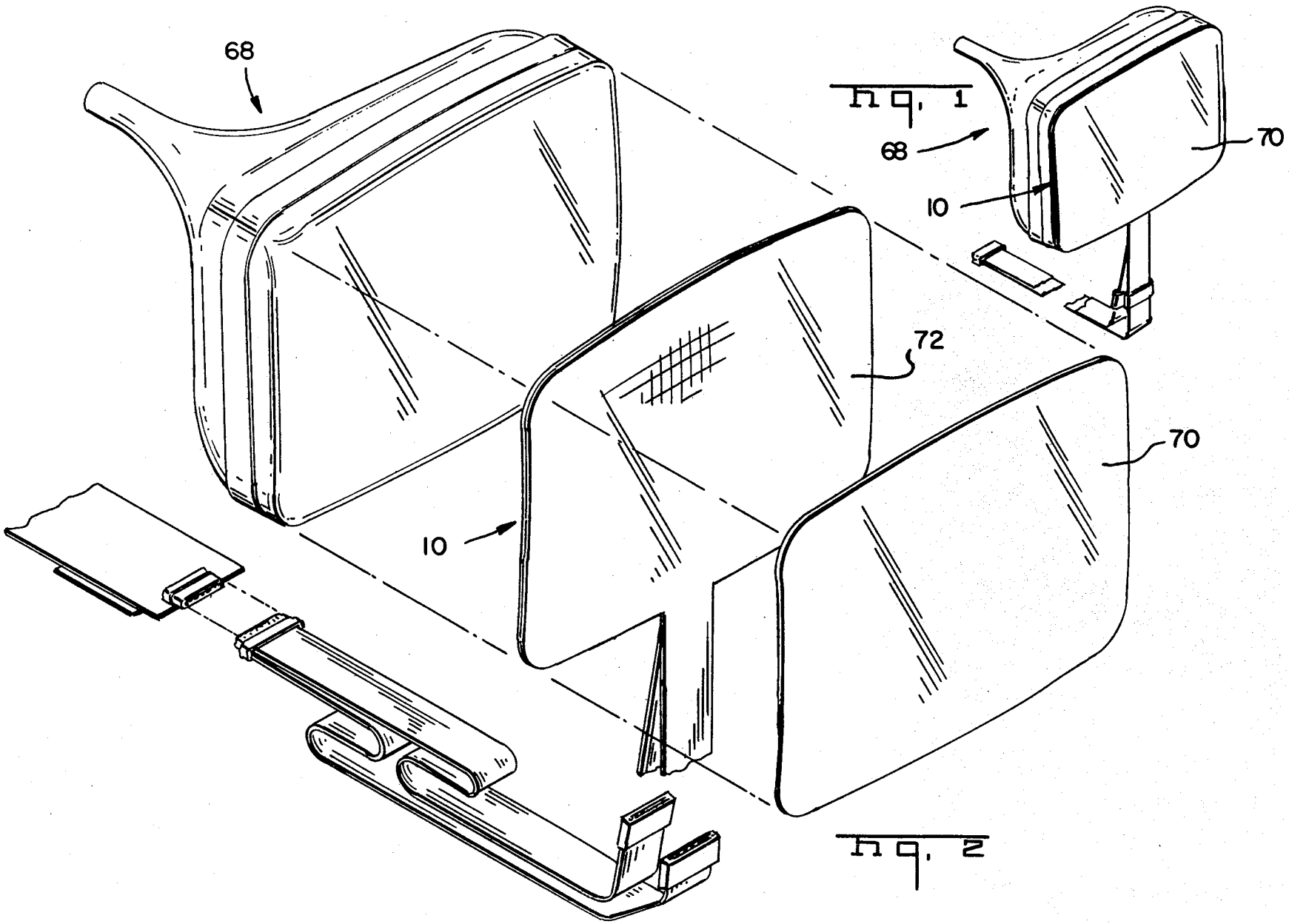
FIG. 1 is a three dimensional view of the preferred embodiment of the membrane switch assembly and a filter mounted on a cathode ray tube.
FIG. 2 is an exploded view of the device shown in FIG. 1.

Referring to FIGS. 1 and 2, a membrane switch assembly 10 is intended for mounting on a cathode ray tube 68. These figures also illustrate the use of a filter 70 disposed over the external surface 72 of the membrane switch assembly 10.

Figure 9:
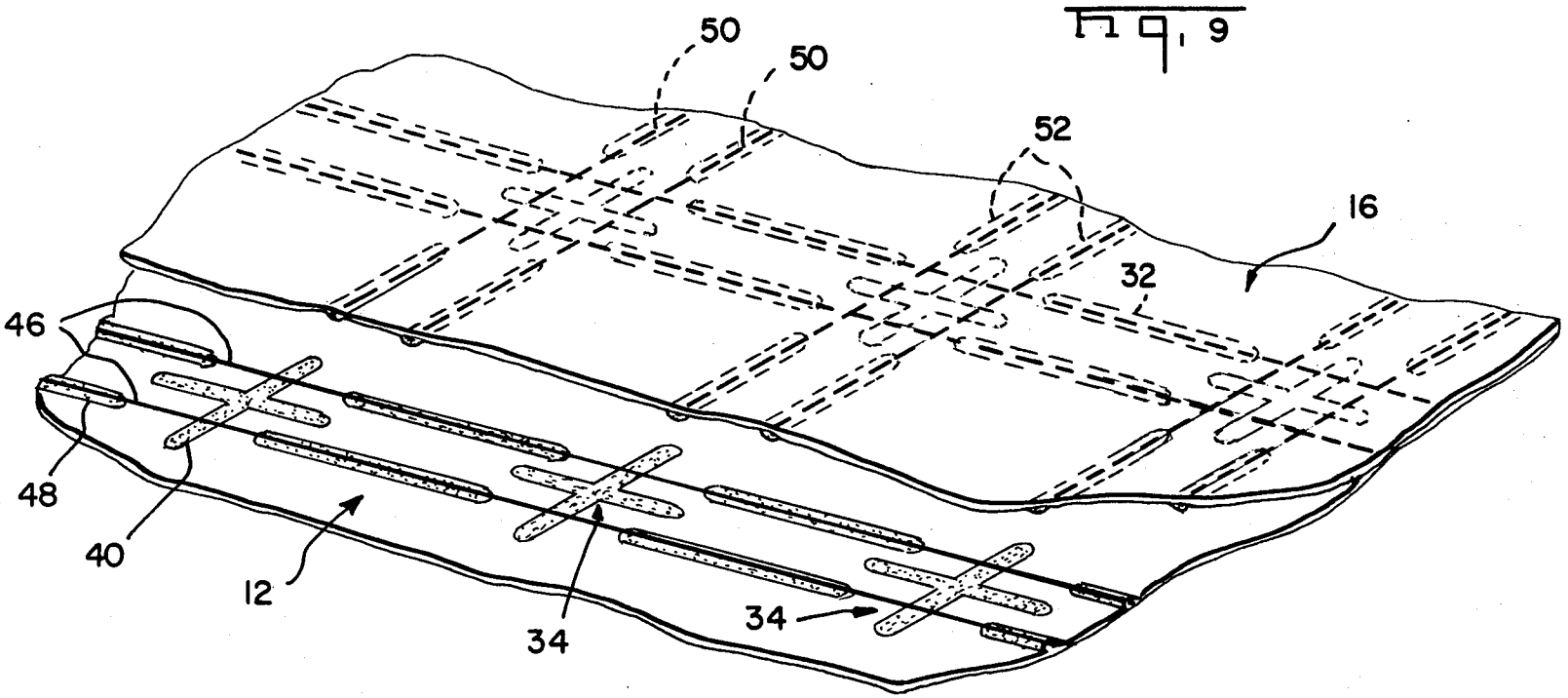
FIG. 9 is a fragmentary view of the membrane switch assembly illustrating the pattern of double conductors and polymer spacer in the completed membrane switch assembly.

Referring now to FIG. 9, the assembly 10 is comprised of two layers 12 and 16 of substantially transparent film, the internal surfaces 14 and 18 of layers 12 and 16 having a plurality of electrodeposited double hairline conductors 20 thereon, the conductors crossing and being normally spaced from each other at the switch sites 34, the layers 12 and 16 being separated from each other by polymer spacer 32, applied over the conductors, the spacer being discontinuous at switch sites 34.

Figure 3:
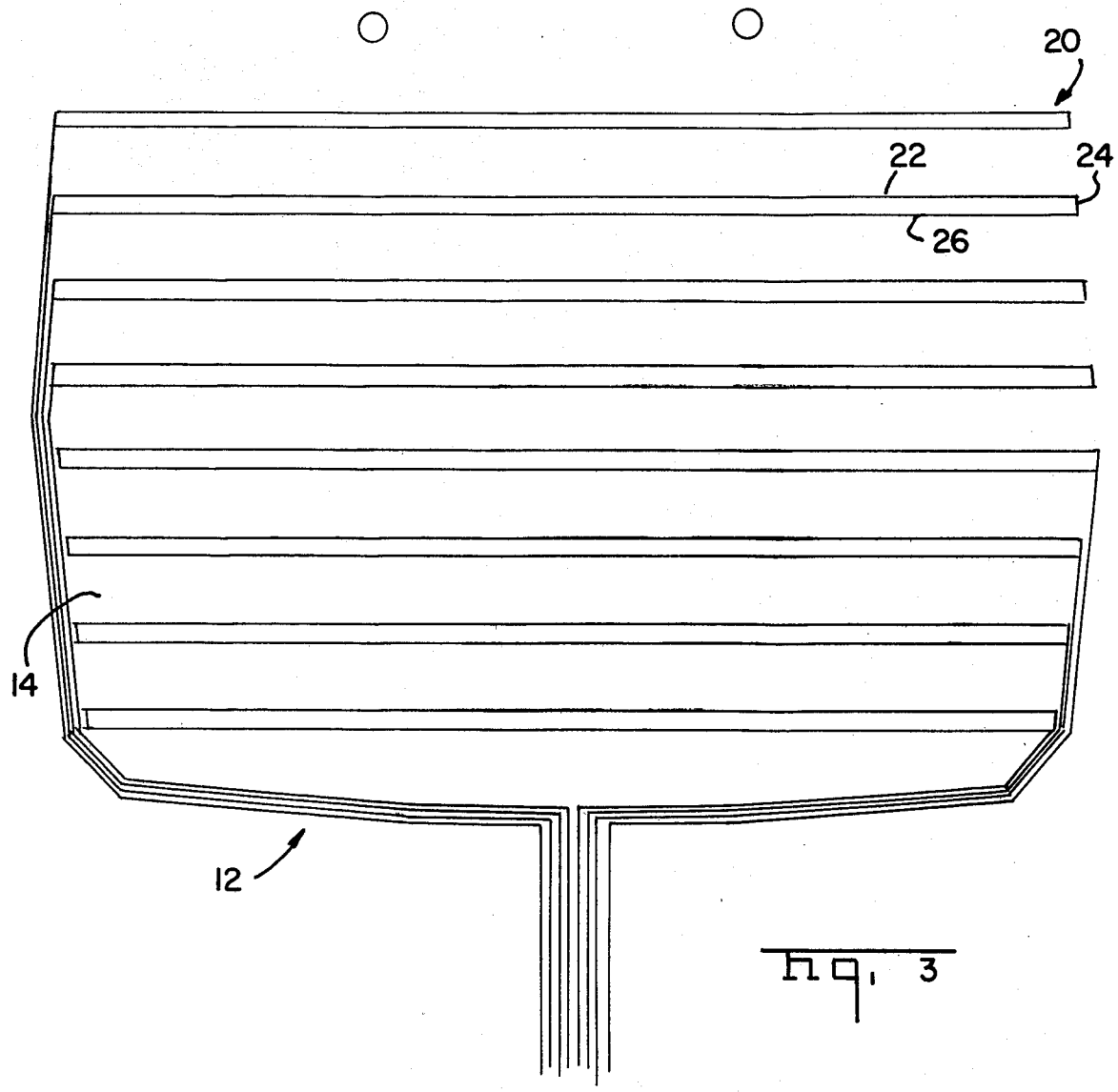
FIG. 3 is an orthographic view of the pattern of double conductors deposited on one layer of the film.
Figure 5:
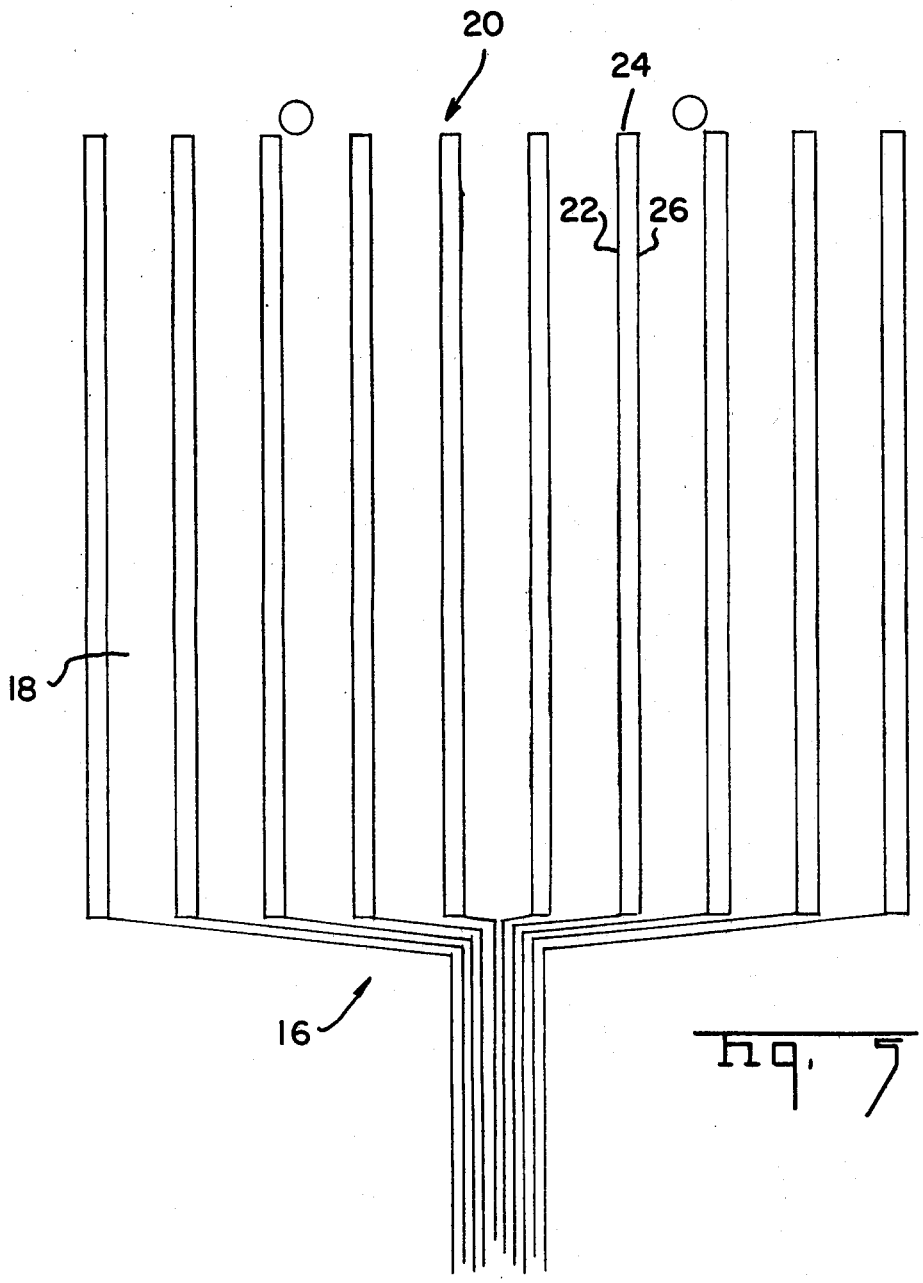
FIG. 5 is an orthographic view of the pattern of double conductors deposited on the second layer of film.

The double conductors 20 as shown in FIGS. 3 and 5 have a first portion 22, an intermediate portion 24 and a second portion 26. Each conductor 20 is reversely bent in its intermediate portion 24 so that the first and second portions 24 and 26 of the conductor are spaced apart and essentially parallel to each other.

Figure 7:
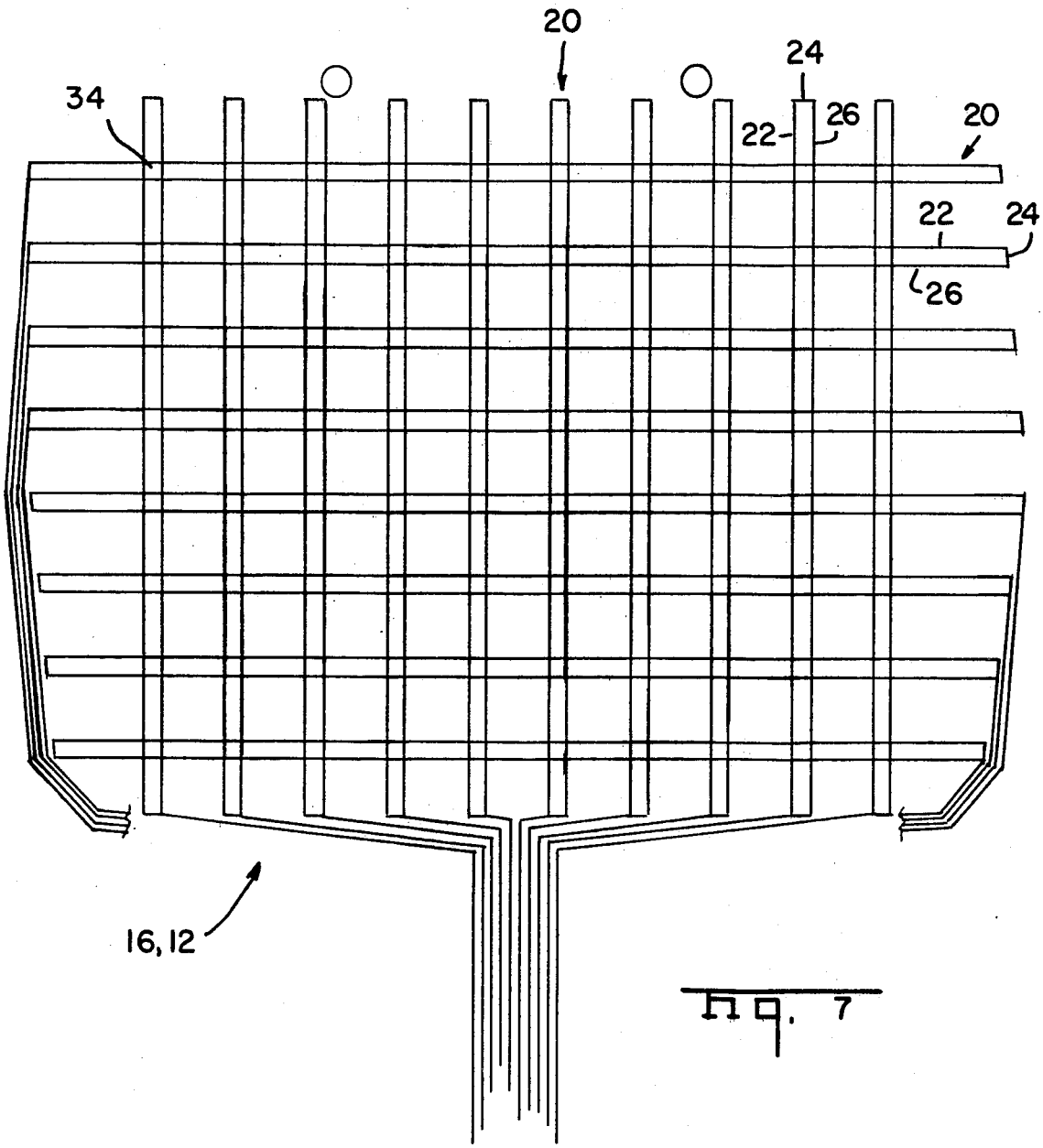
FIG. 7 is an orthographic view of the double conductor pattern of the completed membrane switch assembly.

As further illustrated in FIGS. 3 and 5, the conductors 20 are deposited on the internal surface 14 of the first layer 12 in a direction normal to the direction of the double conductors 20 deposited on the second layer 16. As is shown in FIG. 7, the conductors 20 on the two layers 12 and 16 cross and are normally spaced apart at the switch points 34.

Figure 4:
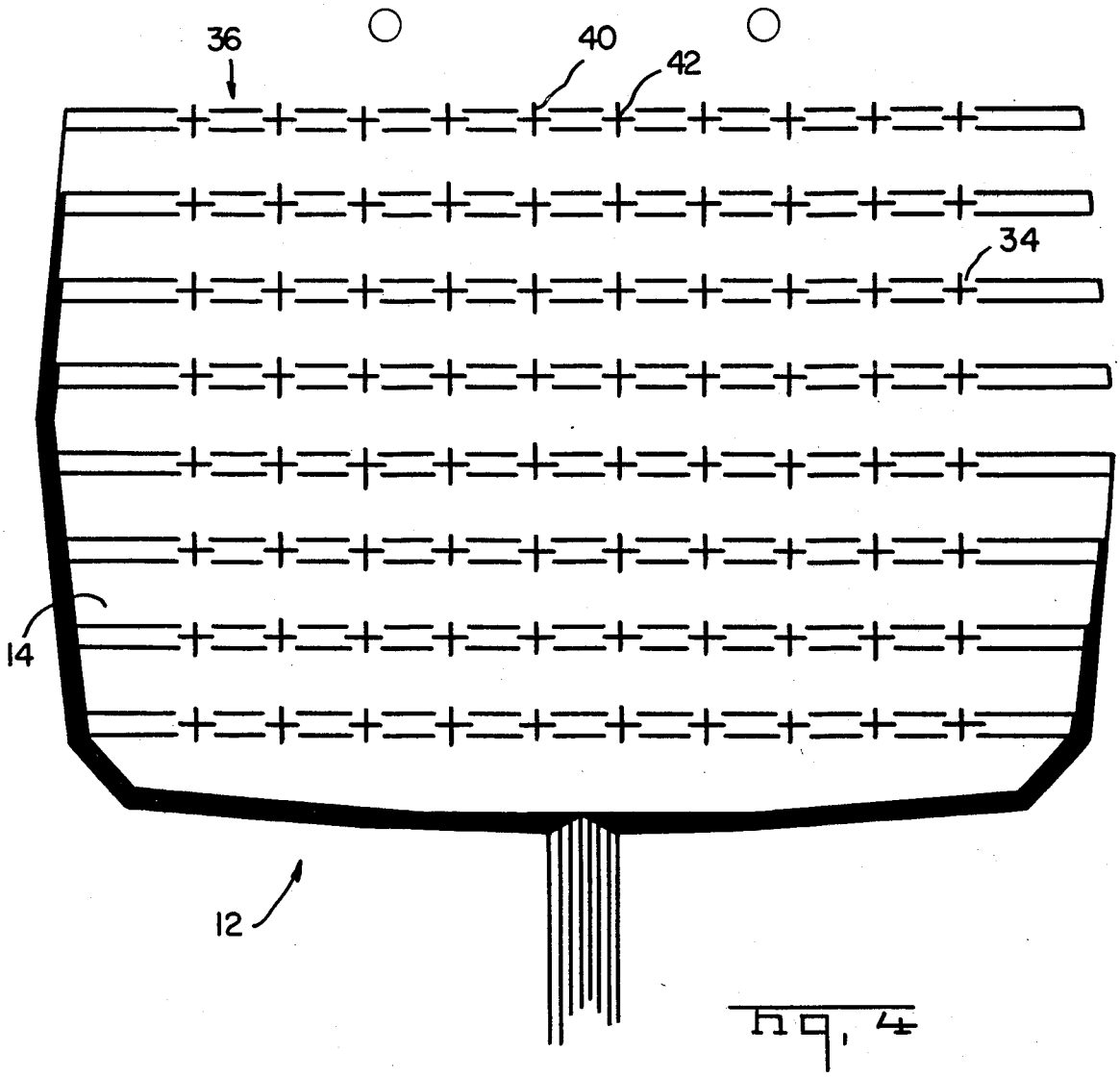
FIG. 4 is an orthographic view of the polymer spacer pattern deposited on the double conductors of FIG. 3.
Figure 6:
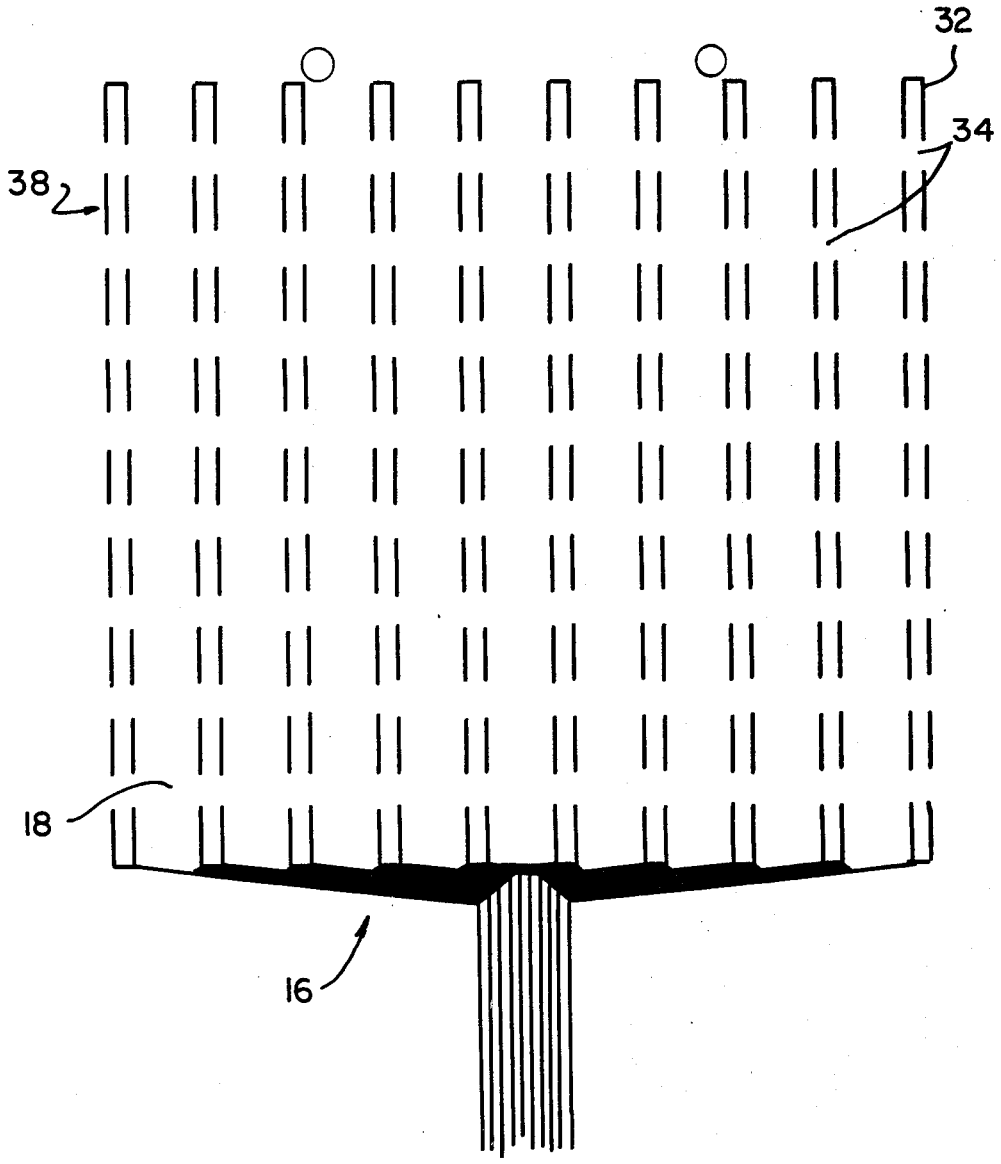
FIG. 6 is an orthographic view of the polymer spacer pattern deposited on the double conductors of FIG. 5.
Figure 8:
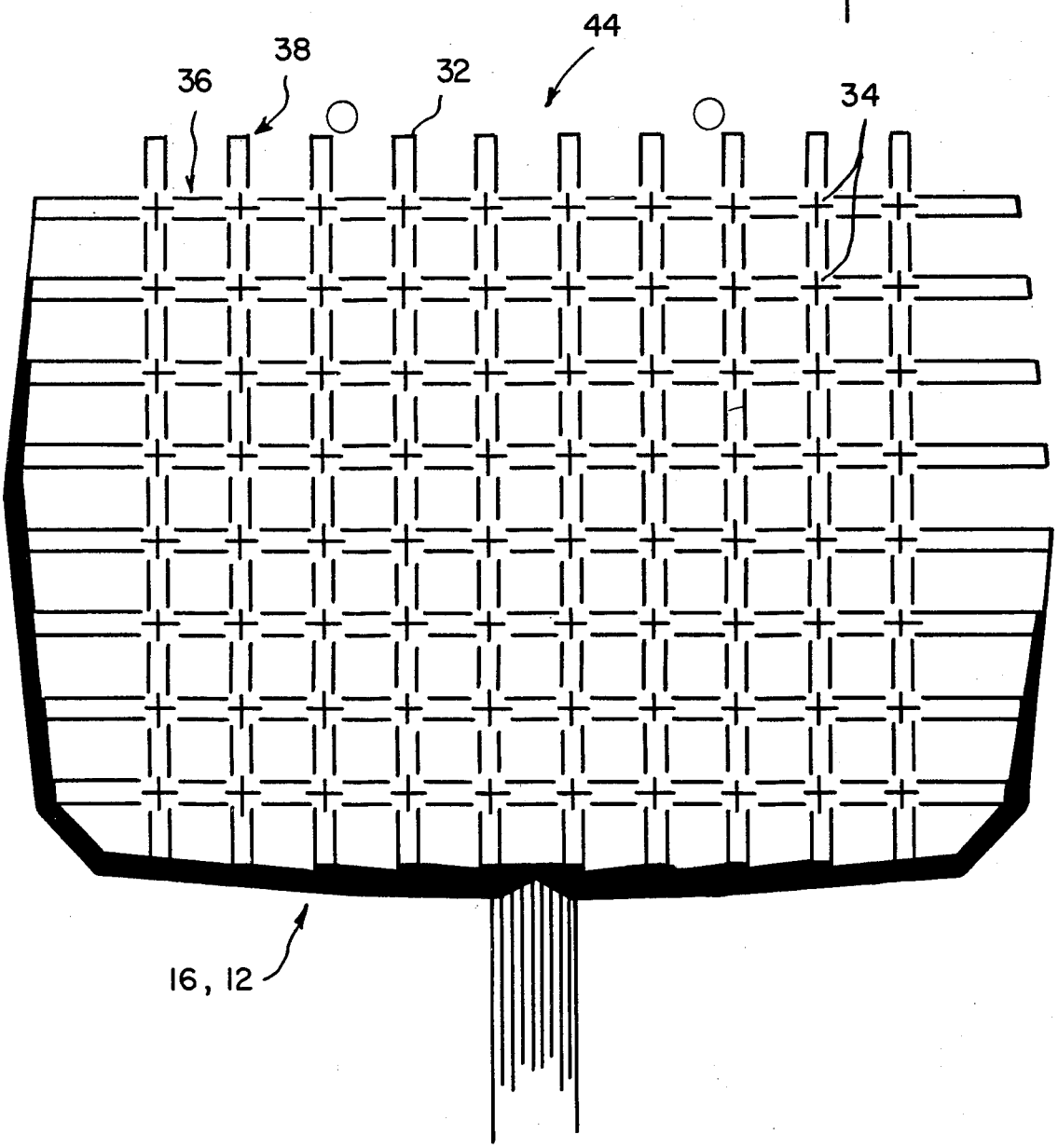
FIG. 8 is an orthographic view of the polymer spacer pattern deposited on the double conductors in the completed membrane switch assembly.

Referring to FIGS. 4, 6 and 8, the polymer spacer 32 is applied over the double conductors 20. For purposes of clarity, the double conductors 20 have been eliminated from these figures. The spacer 32 is discontinuous at the switch sites 34. FIG. 4 shows the polymer spacer pattern 36 deposited on the first layer 12. FIG. 6 shows the polymer spacer pattern 38 deposited on the second layer 16. FIG. 4 also illustrates the isolated cross shaped deposit 40 of polymer spacer deposited at the center 42 of the switch sites 34. This cross shaped deposit can be made on either layer 12 or 16 of the film. FIG. 8 illustrates the pattern 44 of the polymer spacer in the completed membrane switch assembly.

Figure 10:
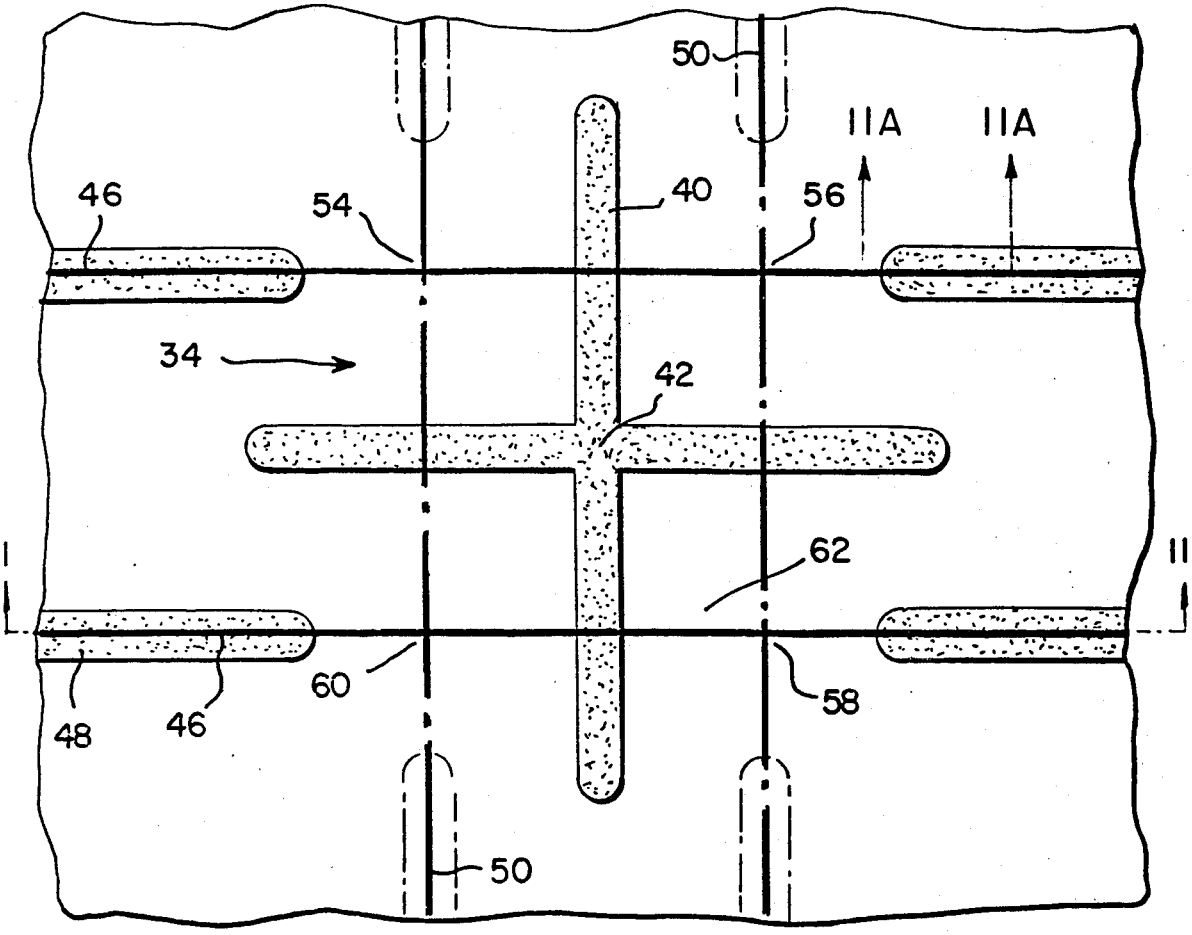
FIG. 10 is an enlarged view of a switch site.

Referring now to FIGS. 9 and 10. FIG. 9 is a fractional view of a portion of the membrane switch assembly 10. The lower layer conductors 46 are represented by a solid line and the upper layer conductors 50 are represented by broken lines. The lower layer polymer spacer 48 and the cross shaped center spacer 40 are stippled, while the upper layer polymer spacer 52 is represented by broken lines. As is illustrated by these drawings, the spacer 32 is not deposited over the conductors in the switch site areas 34.

The operation of the invention is best illustrated by referring to FIG. 10. When the switch site 34 is pressed, the double hairline conductors 46 and 50 are compressed around the spacer to make electrical contact. Because each conductor 20 is a double hairline at each switch site; the lower and upper conductors 46 and 50 cross at four locations, 54, 56, 58 and 60, thus enabling the circuit to be completed at any of these locations. Thus, when force is applied in the center 42 of the switch site, electrical contact may actually be made at all four locations. If force is applied, for example, at the outer area 62 of the switch site, electrical contact will still be made at location 58.

Figure 11:
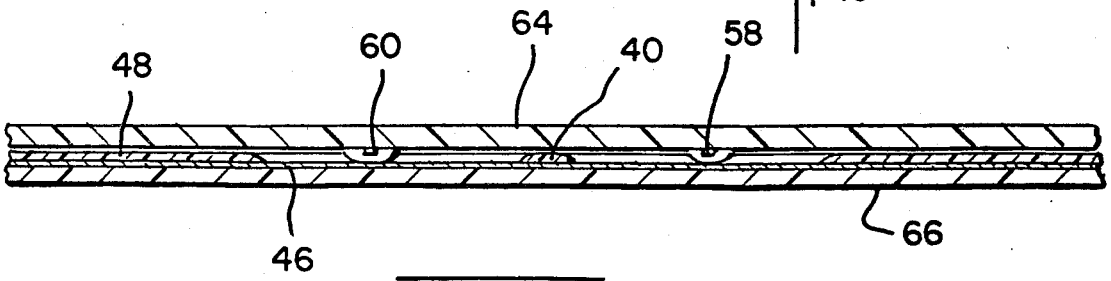
FIG. 11 is a cross-sectional side view taken along the lines 11—11 of FIG. 10.

FIG. 11 is a cross-sectional view taken along line 11—11 of FIG. 10. The upper layer 64 of film is separated from the lower layer 66 of film by the upper spacer 48, the cross shaped center spacer 40. The upper and lower layer conductors cross at locations 58 and 60.

Figure 11A:
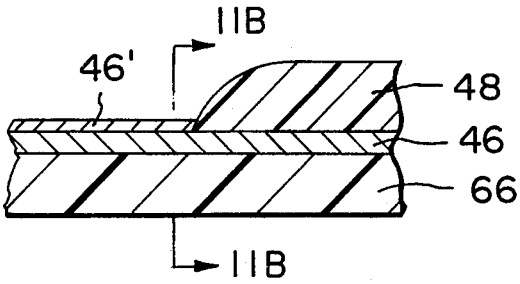
FIG. 11A is an enlarged cross sectional view taken along the lines 11A—11A of FIG. 10.
Figure 11B:
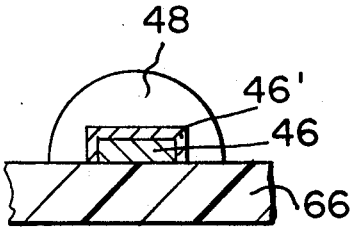
FIG. 11B is a cross sectional view taken along the lines 11B—11B of FIG. 11A.

FIG. 11A is an enlarged cross sectional view taken along line 11A—11A of FIG. 10 illustrating a layer 46' of plating on the exposed portion of the copper conductors 46. The plating 46' covers the sides and top of the conductors 46 as is shown in FIG. 11B.

In making the membrane switch assembly, the double hairline parallel copper conductors 20 are deposited on sheets of transparent film. A number of methods can be used for producing selected metallic patterns on the film. These methods are disclosed in numerous patents, among them, U.S. Pat. Nos. 3,259,559, 3,562,005 and 4,143,253.

The conductors are deposited as double hairlines in order to provide for redundancy at the switch sites. Redundancy is a desirable feature to ensure that electrical contact will still be made at the site in the event force is applied at the outside edge of the switch site rather than the center of the site. Redundancy is also a desirable feature to ensure that electrical contact will be made in the event there is a break somewhere in one of the lines.

In the preferred embodiment, the lines of the double hairline conductor are approximately 5 mils wide, but other width lines may also be used. The distances between the two lines of each conductor and the adjacent conductors varies according to the number and size of switch sites. The switch sites need to be sufficiently spaced apart so that when force is applied to the site, the circuit is completed only at the desired site. Furthermore, the size and curvature of the cathode ray tube presents problems of parallax. The switch site must be of sufficient size to permit actuation even when the force is not applied in a direction normal to the site. The distance between the lines of a double conductor also determines whether an isolated spacer is needed at the center of the switch site to prevent sagging of the upper film layer and accidental completion of the electrical circuit. For example, with membrane switch assemblies having parallel lines of each double conductor 200 mils apart, a center spacer was also required to keep the first and second film layers separate.

After the double conductors were deposited on the film layers, an ultraviolet curable polymer was applied parallel to and over the traces, except at the switch sites. The polymer may be applied using a variety of methods including silkscreening and transfer printing. This polymer is the spacer which keeps the two layers separated until force is applied to complete a circuit. An isolated deposit may be applied to one layer at the center of the switch site.

A number of polymers can be used for this purpose. The polymer used should meet the following criteria. The polymer should be essentially optically clear. It should also be sag resistant and stable at the temperature of the operating cathode ray tube and the temperature required for manufacturing the assembly. One polymer which can be used is Colonial 580-319 available from Colonial Printing Ink Co., East Rutherford, N.J. 07073.

In addition to being a spacer, the polymer also can be used as a mask for plating a noble metal over the copper at the switch sites. If this plating is desired, use of the polymer spacer according to the disclosed invention minimizes the amount of precious metal needed since the only copper exposed and available for plating is at the switch sites, thereby reducing the cost of the assembly. (See FIGS. 11A and 11B) Gold, silver, and palladium can all be used.

After the polymer spacer has been deposited on the film and any additional plating has been completed, individual layers are profiled to shape and formed to the desired spherical radius. After forming the layers are adhered together along their perimeters to complete the assembly.

The double hairline conductors being only 5 mils or less wide are nearly invisible when the assembly is mounted on a cathode ray tube. A filter may be disposed over the assembly to give an essentially optically clear screen. Use of a filter also reduces glare from the CRT and protects the surface of the assembly.

What is claimed is:

1. A membrane switch assembly comprised of two layers of substantially transparent film having internal surfaces that are separated from each other by spacing means, the spacing means having openings therein constituting switch sites, the internal surfaces of each layer having electrodeposited hairline conductors thereon, the conductors crossing and being normally spaced from each other at the switch sites, the assembly being characterized in that:

the internal surface of the first layer has a plurality of electrodeposited spaced-apart parallel double hairline conductors, each double conductor having a first portion, an intermediate portion, and a second portion, the first and second portions of the double conductor being essentially parallel to each other, with the intermediate portion connecting the first and second portions, the distance between the first and second portions of each double conductor being less than the distance between adjacent conductors, the internal surface of the second layer has a plurality of spaced-apart parallel double hairline conductors electrodeposited in a direction normal to the direction of the first layer conductor, the first sites being created by the crossing double hairline conductor of the first and second circuit layers when they are assembled, thus giving four points of contact at each site, the spacing means is a polymer spacer comprised of an insulating ultraviolet curable polymer applied in parallel strips over the conductors, the polymer spacer being discontinuous at the switch sites, whereby, as force is applied at the switch site to bring the two layers of conductors together, an electrical circuit can be completed at any one of four crossing locations thus providing redundancy and insuring the completion of the electrical circuit even if the force has been applied at the periphery of the switch site.

2. The membrane switch assembly as set forth in claim 1 wherein the spacing means is further comprised of an isolated deposit of polymer spacer applied onto the internal surface of one layer of the film at the switch sites, the deposit being centrally located to the four crossing locations.

3. The membrane switch assembly as set forth in claim 2 wherein the deposits of the spacer at centers of the switch site are essentially in the form of a cross with the first bar of the cross extending essentially parallel to and equidistant from the first and second portions of the double hairline conductors deposited on one layer and the second bar of the cross extending essentially normal to the first bar so that the second bar in the assembled switch lies essentially parallel to and equidistant from the first and second portions of the double hairline conductors deposited on the other layer.

4. The membrane switch assembly as set forth in claim 1 wherein the polymer spacer is essentially optically clear.

5. The membrane switch assembly as set forth in claim 1 wherein the polymer spacer also serves as a plating mask.

6. The membrane switch assembly as set forth in claim 1 wherein a noble metal, selected from the group consisting of gold, silver, and palladium, has been plated on the switch site.

7. The membrane switch assembly as set forth in claim 1 mounted on a cathode ray tube.

8. The membrane switch assembly as set forth in claim 1 wherein a substantially transparent filter is dispersed over the external surface of the outermost layer of the switch assembly.

* * * * *